United States Patent [19]

Kosowsky et al.

[11] Patent Number: 4,797,683

[45] Date of Patent: Jan. 10, 1989

[54] MULTI-SPECTRAL RADOME

[75] Inventors: Lester H. Kosowsky, Stamford; Peter E. Raber, Milford, both of Conn.; Brian J. Horais, Oakton, Va.

[73] Assignee: United Technologies Corporation, Hartford, Conn.

[21] Appl. No.: 913,898

[22] Filed: Oct. 1, 1986

[51] Int. Cl.[4] ..... H01Q 1/42; H01Q 1/28

[52] U.S. Cl. ..... 343/872; 343/705

[58] Field of Search ..... 343/705, 872, 909, 708

[56] References Cited

U.S. PATENT DOCUMENTS

| | | | |
|---|---|---|---|
| 3,002,190 | 4/1955 | Oleesky et al. | 343/872 |
| 3,396,400 | 9/1968 | Kelly et al. | 343/909 |
| 3,616,140 | 10/1971 | Copeland | 343/872 |
| 3,864,690 | 2/1975 | Pierrot | 343/909 |
| 4,358,772 | 11/1982 | Leggett | 343/872 |

*Primary Examiner*—William L. Sikes

*Assistant Examiner*—Doris J. Johnson

[57] ABSTRACT

Dual radome arrangement (15) comprising inner and outer layers (14,16) respectively transmissive to both modes of radiation operable in a detection system (11), and only one of the modes of radiation, and the outer layer (16) being selectively removable.

6 Claims, 2 Drawing Sheets

MULTI-SPECTRAL RADOME

CROSS REFERENCE TO RELATED APPLICATIONS

The subject matter of this application is related to the subject matter of commonly-owned U.S. patent application Ser. Nos. 800,938 entitled "Multimode, Multispectral Antenna" filed on Nov. 22, 1985 and Attorney Docket N-1130 and N-1140 both entitled "Multimode, Multispectral Scanning and Detection" filed on even date herewith which are expressly referenced to and incorporated herein by such reference.

TECHNICAL FIELD

This invention is directed toward the art of multimode detection systems, and more particularly, toward airborne multimode detection systems employing radar and infrared detection techniques.

BACKGROUND ART

Many different kinds of multimode scanning and detection systems are currently known. Such systems may be active or passive in operation, being operationally effective in scanning or detecting multiple beams of radiation at multiple frequencies and wavelengths. The frequencies of operation include infrared radiation, in which heat is detected to identify a particular target or target region. Detection may be accomplished in the radar or radio frequency bands, accomplished either actively or passively, or with a combination of active and passive modes.

The term multimode can further be taken to refer to detection at one mode of energy operating at a given frequency, and also at another mode operating at the same or at a different frequency. Since several modes or frequencies of the electromagnetic spectrum are used, this approach is frequently referred to as multi-spectral. Multimode can further be taken to mean the use of both active and passive bands of radiation. It can further mean the use of one or more radar bands of radiation and one or more infrared bands. Multimode detection systems can moreover be ground based, ship based, airborne or set aloft in space.

In general, multimode detection systems enhance the detection flexibility and effectiveness of the system using the technique. For example, one beam can be designed to be wide in shape in order to conduct search operations, and the other beam can be narrow in order to accomplish tracking once the target has been identified. The different modes can relate to the distance or range of detection as well. For example, one mode can be used at short range and the other mode at extended ranges. In other words, the radar mode can be used at long ranges and the infrared detection can be employed closer in. The different modes also represent different operational capabilities. For example, radar can operate in poor weather while infrared techniques are limited under such conditions. However, infrared can provide significantly better resolution than radar, and can operate passively and therefore covertly.

The various modes of operating such detection systems can further be used in combination with each other in order to accomplish effective target classification and identification. For example, targets often appear different in different spectral regions, and the degree of difference can be used to distinguish one type of target from another. Some problems in multimode systems are due to the relationship between the various modes and the implementation of these modes in a system. Many such problems faced in implementing multimode multispectral systems are inherent in the refractive materials used for the radome (as well as the lens and scanning system) which must permit unhampered egress and ingress of the required bands of radiation.

Some materials, for example, which are transparent in one band may be opaque or only semitransparent in others, and other materials may be transparent in all bands of interest, but subject to different refractive indices and/or degrees of birefringence for each band. Furthermore, materials which may be suitable optically for one or even for all bands of interest, may be unsuitable for use in a radome, because they cannot survive extended exposure to harsh environments, such as those experienced by a radome flying long distances through rain or the like.

Chemical attack (e.g., by humidity, smoke, etc.) and high temperature (induced by atmospheric friction at high speeds, for example) are also of concern for radomes. However, rain erosion is a particularly serious and well-known problem for zinc sulfide and zinc selenide, which are relatively soft but otherwise excellent materials for the 8–12 micrometer infrared band. The mechanism of rain erosion involves impact at high relative velocity between the radome and the raindrops. The consequent microfracturing of the surface increases reflective losses and causes any antireflection coatings applied to the radome to lose their adherence. (By inference, abrasives such as dust and sand would be of similar concern). Rain-erosion-resistant coatings are under development in an effort to surmount this problem, but to date, such coatings have provided only a modest degree of protection under specific sets of test conditions; they cannot protect a radome throughout the entire flight duration and under conditions of potential environmental severity envisioned for a multi-spectral radar/IR antenna.

Enemy countermeasures including laser radiation may also inflict damage on radomes or on the sensor behind them. Laser radiation to which the radome is opaque may raise the radome temperature high enough to cause it to melt or crack for example. Laser radiation to which the radome is transparent may damage the sensor scanner or may even be focussed by the lens onto the detector.

The 8–12 micrometer band is one of two particularly significant infrared spectral regions in which Earth's atmosphere is transparent; the other is the 3–5 micrometer region. For the latter, a commonly accepted material is sapphire, a crystalline form of alumina, which has excellent resistance to abrasion, moisture, and high temperature. Sapphire is slightly birefringent at visible wavelengths and in the 3–5 micrometer band, but this is of little concern for passive detection of unpolarized infrared radiation. At radar frequencies, however, this birefringence is enormous; it would produce unacceptable alterations of polarization states if sapphire were used for a radome. Polycrystalline alumina "randomizes" this birefringence on a microscopic basis, and is, therefore, more suitable for radar. Unfortunately, this is achieved at the cost of transparency in the infrared and visible regions. However, other forms of alumina are available which are ideal for multi-spectral radomes, since they are not birefringent, but they retain the environmental advantages of sapphire and polycrystalline alumina. Such materials include aluminum oxynitride (ALON), a nitrogen-stabilized alumina, and MgO spinel. Unfortunately, all such forms of alumina are opaque in the 8–12 micrometer infrared regions, which is of great importance in many applications for which the 3–5 micrometer region is inadequate. The same problem exists with magnesium oxide and other environmentally stable materials.

DISCLOSURE OF THE INVENTION

The invention herein is accordingly directed toward a new and improved dual or multimode radome arrangement comprising thick inner and outer layers, the outer layer effectively providing environmental protection to the inner layer, and being transmissive to at least one of the modes of radiation used by the detection system.

According to one version of the invention, the outer layer is removeable during operation to render the radome selectively transmissive to all the predetermined modes of radiation.

Other features and advantages will be apparent from the specification and claims and from the accompanying drawings which illustrate an embodiment of the invention.

BEST MODE FOR CARRYING OUT THE INVENTION

Figure 1:
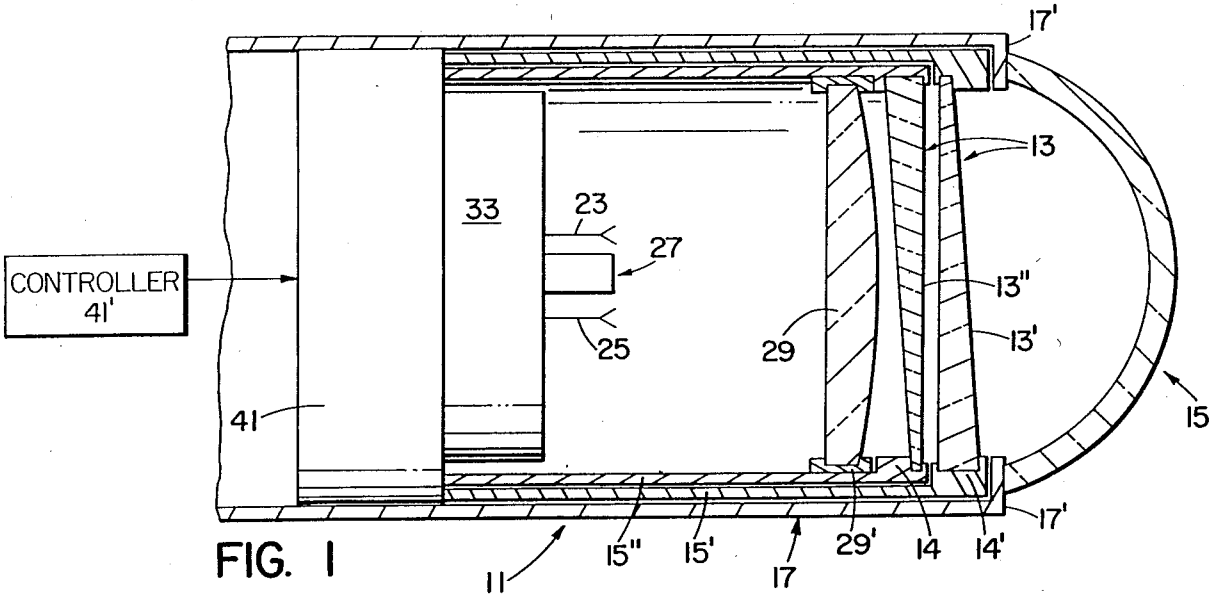
FIG. 1 PRIOR ART
FIG. 1 shows a portion of the detection system in partial cross section.

FIG. 1 shows a multimode detection system 11 including rotatable scanning prisms 13 and a radome 15. The detection system 11 includes tubular walls 17 and flange 17' for containing and holding scanning prisms 13, and for supporting and mounting radome 15. The arrangement 11 further includes an infrared sensor 27 and a pair of radar feeds 23 and 25 suitably mounted within the structure of arrangement 11. Beams of radiation progressing to and from respective sensors 23, 25 and 27 pass through collimating and shaping lens 29 and are suitably scanned and directed by scanning prisms 13.

FIG. 1 further shows the collimating lens 29 held in place flangedly, for example. Further, the scanning lens 13 is secured and mounted in a structure which can include a rotating mechanism including concentric cylinders 15' and 15'' suitably, mechanically coupled to the drive mechanism 14.

Figure 2:
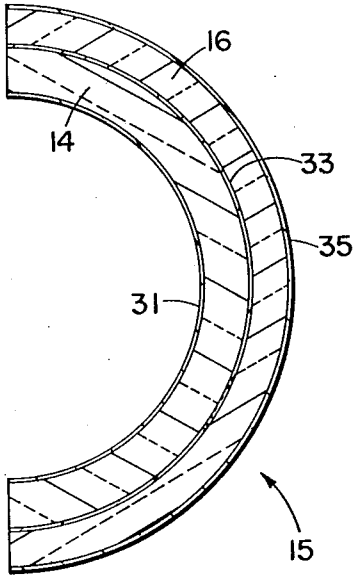
FIG. 2 shows a cross section of the multilayer multimode radome according to the invention herein.

FIG. 2 shows radome 15 in greater detail, particularly being in cross section. Both inner layer 14 and outer layer 16 of radome 15 are shown. In a preferred embodiment, as shown, the outer layer 16 conformally matches the inner layer 14. However, the two layers, 14 and 16, can be constructed with a separating gap 40 shown in FIG. 3.

The purpose of the outer layer 16 is to be transmissive to at least one of the selected modes of radiation, while simultaneously serving a protective or defensive function. According to a preferred embodiment of the invention, this outer layer 16, composed of a material resistant to rain, abrasion and high temperature, is transmissive to radar, and serves as environmental and countermeasure-resistant protection for the inner layer 14 and for the remainder of the sensor including lens and scanner. In another embodiment, the outer layer is shaped and otherwise designed by coating, thickness and/or choice of materials to incorporate low radar cross section characteristics. The inner layer 14 must of course be transmissive to all modes of operation for which the system is designed.

The thicknesses of layers 14 and 16 are preferably chosen so as to optimize transmission of the lowest operating frequency mode to which both are transparent by minimizing surface reflectivity, according to well-known relationships between reflectivity, thickness, and refractive index. When this is done, care must be taken to ensure that the thickness of layer 14 is such that reflection is minimized for the lowest frequency mode utilized after removal of layer 16, as well as ensuring that he entire radome 15 is optimized for the mode or modes transmitted when layer 16 is in place.

According to another version of the invention, the outer layer 16 is removeable mechanically or by other techniques as will be seen below.

According to one such version, explosive charges can be set on the engaging or holding flanges of the outer layer 16. When set off and discharged, these explosive charges remove the outer layer.

In this fashion, the outer layer 16 can protect the inner layer from rain erosion, abrading and other damage during the primary portion of flight by the airborne detection system toward a target. Further, the detection system is fully operable in at least one mode, for example radar, even before the outer layer 16 is removed, and in all its modes after the outer layer 6 has been removed.

Under another version of the invention, the outer layer 16 and the inner layer 14 are both transmissive to all modes of the radiation contemplated for operation in arrangement 11, thus permitting all modes to be operable during the entire flight time of the detection system. In this version, the purpose of the outer layer 16 would be to absorb unusual, unexpected, or antagonistically-inflicted damage during operation of the detection system. The outer layer 16 is then to be removed at a selected moment in order to allow the mission to continue unimpeded by such damage.

FIG. 2 also shows first, second and third coatings 31, 33 and 35 (each coating in turn comprising one or more layers) which may be optionally employed to enhance transmission efficiency in the infrared and visible spectral regions. Such reflection-reducing coatings are typically of the thin-film type, and are much thinner than layers 14 and 16. (If desired, coating 33 may, for example, also be of the rain-erosion-resistant type, in order to retain a small degree of protection after layer 16 is removed). Such coatings are well-known, and are not the subject of this invention.

Figure 3:
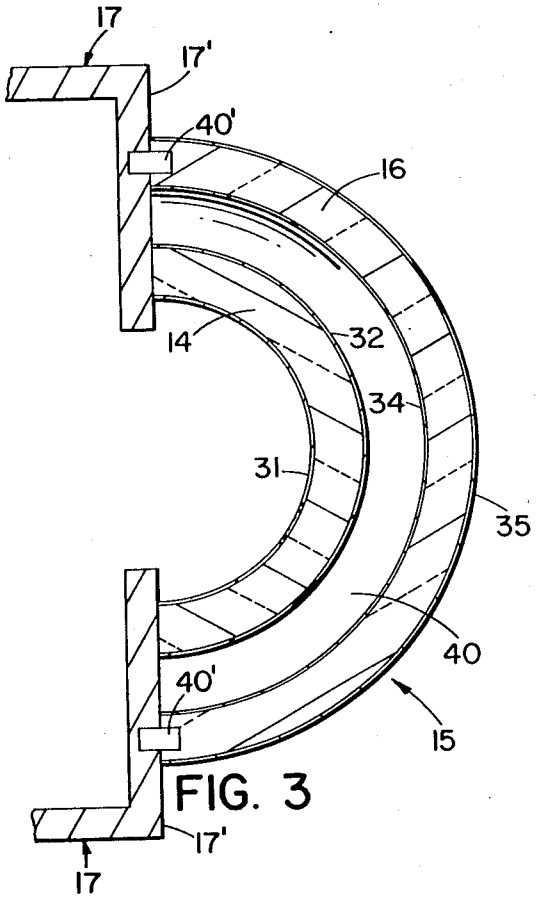
FIG. 3 shows a cross-section of the multilayer multimode radome according to another embodiment, in which the layers are separated by a gap or by another material.

FIG. 3 as already noted shows an embodiment of the invention in which layers 14 and 16 are separated by a gap 40. Outer layer 16 further includes means 40' for removing the outer layer 16 from tubular walls 17. Means 40' may for example include blasting caps for explosively removing outer layer 16. Other means 40' could be employed in lieu thereof, such as for example, heaters between layers 14 and 16, generating sufficient heat to shatter outer layer 16.

Respective optional coating 32 and 34 on inner layer 14 and outer layer 16, respectively, take the place of coating 33 used in the version of FIG. 2. Gap 40 may represent air or empty space or it may consist of a third material chosen for its refractive index matching properties or for other design reasons. In any event, its effect on net radome reflectivity in conjunction with layers 14 and 16 must be taken into account when defining its thickness according to well-known techniques.

As an example of a radome designed using these principles, consider a hemispherical inner layer 14 made of zinc selenide, and a concentric outer layer 16 composed of MgO spinel. For radar frequencies in the 17 GHz range, the index of refraction of both these materials is approximately 3. This indicates the desirability of FIG. 2 approach, since no intermediate layer is required in order to eliminate reflection of the 17 GHz beam at the interface. (This reflectivity is zero when both indices are identical). The thickness of the entire radome is chosen so that exactly an integral number of half-wavelengths of the 17 GHz radiation pass through it, and the thickness of layer 14 is chosen according to the same principle. This ensures that reflected 17 GHz radiation is cancelled. Thus, for example, layer 14 might be chosen to be 17.6 mm thick and layer 16 might be chosen to be 5.9 millimeters thick, hhereby not only satisfying the reflectivity requirements, but also providing adequate structural strength in a dome less than one inch thick. Coating 35 would be unnecessary, and coatings 31 and 33 would be optimized for the 8–12 micrometer infrared region, for optimum performance after inflight removal of layer 16. In that spectral band, the index of refraction of the zinc selenide layer 14 is 2.4 rather than 3. However, this is immaterial for reflection considerations, because the reflectivity of 8–12 micrometer radiation is controlled not by the thickness of layer 14, but by the coatings 31 and 33. Conversely, these coatings, with a thickness appropriate for infrared reflection reduction, are negligibly thin compared to the thickness of layer 14. They therefore have practically no effect on the reflectivity of the 17 GHz radar frequency.

It should be understood that the invention is not limited to the particular embodiments shown and described herein, but that various changes and modifications may be made without departing from the spirit and scope of this novel concept as defined by the following claims. In particular, it is clear that the layers and coatings referred to each may be multiple, and that the multispectral nature of the radome is not limited to specific radar and/or infrared spectral bands.

We claim:

1. A dual radome for permitting the ingress and egree of selected first and second frequency bands of radiation comprising inner and outer layers disposed about means for transmitting and/or receiving electromagnetic radiation in both said first and second frequency bands, in which said inner layer is transmissive to both said first and second frequency bands of radiation, and characterized in that:

said outer layer is transmissive to at least one of said bands of radiation;

said outer layer is formed from an abrasion and weather resistant material; and said arrangement includes removing means for removing said outer layer, whereby said radome arrangement is operable in a multimode detection system having a first mode in which said radome passes only radiation in said first frequency band through both said inner and outer layers and a second mode in which said outer layer is removed and said radome passes radiation in both said first and said second frequency bands through said inner layer.

2. The arrangement of claim 1, in which one of said bands of radiation includes at least a portion of the infrared spectrum.

3. The arrangement of claim 2, in which the other of said bands of radiation includes microwave frequencies.

4. A radome according to claim 1, further characterized in that said removing means comprises engaging means for positioning said outer layer and a set of explosive devices for removing said outer layer from said engaging means.

5. The arrangement of claim 4, in which one of said bands of radiation includes at least a portion of the infrared spectrum.

6. The arrangement of claim 4, in which one of said bands of radiation includes microwave frequencies.

* * * * *